US005998773A

United States Patent [19]

Jerby

[11] Patent Number: 5,998,773

[45] Date of Patent: Dec. 7, 1999

[54] LIQUID HEATING IN INTERACTION REGION OF MICROWAVE GENERATOR

[75] Inventor: Eli Jerby, Lezion, Israel

[73] Assignee: Ramot University Authority for Applied Research & Industrial Development Ltd., Tel Aviv, Israel

[21] Appl. No.: 09/000,223

[22] PCT Filed: Jul. 16, 1996

[86] PCT No.: PCT/IL96/00054

§ 371 Date: Jan. 23, 1998

§ 102(e) Date: Jan. 23, 1998

[87] PCT Pub. No.: WO97/05756

PCT Pub. Date: Feb. 13, 1997

[30] Foreign Application Priority Data

Jul. 26, 1995 [IL] Israel ..... 114745

[51] Int. Cl.[6] ..... H05B 6/80

[52] U.S. Cl. ..... 219/688; 219/761

[58] Field of Search ..... 219/687, 688, 219/689, 760, 761, 756

[56] References Cited

U.S. PATENT DOCUMENTS

| | | | |
|---|---|---|---|
| 2,978,562 | 4/1961 | Fox | 219/688 |
| 3,812,315 | 5/1974 | Martin | 219/688 |
| 3,980,855 | 9/1976 | Boudouris et al. | 219/687 |
| 5,300,743 | 4/1994 | Park | 219/689 |

FOREIGN PATENT DOCUMENTS

| | | | |
|---|---|---|---|
| 0 351 300 | 1/1990 | European Pat. Off. | 219/688 |

*Primary Examiner*—Philip H. Leung
*Attorney, Agent, or Firm*—Mark M. Friedman

[57] ABSTRACT

A microwave heater (22) which uses electromagnetic radiation for heating liquid flowing from a liquid source to a liquid receiver. The microwave heater (22) includes a microwave generator having an interaction region (28) within which the electromagnetic radiation is generated. At least a portion of a conduit (30) which has an inlet (32) connected to the liquid source and an outlet (34) connected to the liquid receiver is deployed within the interaction region (28). The liquid flows through the conduit (30) acting as a dielectric load of the microwave generator so as to be heated by the electromagnetic radiation.

19 Claims, 4 Drawing Sheets

LIQUID HEATING IN INTERACTION REGION OF MICROWAVE GENERATOR

FIELD AND BACKGROUND OF THE INVENTION

The present invention relates to microwave devices in general. In particular, it concerns compact, efficient microwave devices for heating liquids.

It is known to use electromagnetic radiation of microwave frequencies to heat various materials, including water and other liquids.

Conventional microwave heating devices have three elements: a microwave generator, a waveguide, and an applicator. The microwave generator, which may be any of a number of types, produces microwaves of a frequency or range of frequencies suited to the material to be heated. The waveguide is coupled at one end to the microwave generator and at the other to the applicator so that radiation passes to the applicator which contains the material to be heated. Depending on the type of material to be heated, the applicator may be a cavity, as in a domestic microwave oven, or an extended waveguide through which the material to be heated is passed.

Conventional microwave heating devices have two major disadvantages. Firstly, the need for a separate waveguide and applicator in addition to the microwave generator limits the minimum size and cost of the device. And secondly, coupling losses both between the microwave generator and the waveguide, and between the waveguide and the applicator, reduce the efficiency of the device. Furthermore, most conventional microwave generators require a high-voltage power supply which leads to a high cost of manufacture.

There is therefore a need for compact, efficient microwave devices for heating liquids which overcomes the aforementioned shortcomings of the prior art.

SUMMARY OF THE INVENTION

The present invention is of compact efficient microwave devices for heating liquids.

Hence, there is provided according to the teachings of the present invention, a microwave heater which uses electromagnetic radiation for heating liquid flowing from a liquid source to a liquid receiver, the microwave heater comprising a microwave generator having: (a) at least one interaction region within which the electromagnetic radiation is generated; and (b) at least one conduit having an inlet connected to the liquid source and an outlet connected to the liquid receiver, a portion of the at least one conduit deployed within at least one of the at least one interaction region, the liquid flowing through the portion acting as a dielectric load of the microwave generator so as to be heated by the electromagnetic radiation.

According to a further feature of the present invention, the inlet is positioned lower than the outlet such that, when the microwave heater is in use, convective effects tend to generate a flow of the liquid from the liquid source to the liquid receiver.

According to a further feature of the present invention, the at least one interaction region is substantially cylindrical and has an axis, and wherein a beam of electrons passes through the interaction region substantially parallel to the axis, the at least one conduit forming a substantially peripheral flow path within the interaction region.

According to a further feature of the present invention, the substantially peripheral flow path is tapered along the axis so as to synchronize the phase velocity of the electromagnetic radiation with the velocity of the beam of electrons along the interaction region.

According to a further feature of the present invention, the interaction region includes an axially periodic structure.

According to a further feature of the present invention, the axially periodic structure is metallic.

According to a further feature of the present invention, the axially periodic structure is helical.

According to a further feature of the present invention, there is also provided means for applying an axial magnetic field through at least part of the interaction region parallel to the axis.

According to a further feature of the present invention, the axial magnetic field is fixed so as to define the frequency of the electromagnetic radiation generated.

According to a further feature of the present invention, there is also provided means for applying a magnetic field through at least part of the interaction region substantially perpendicular to the axis.

According to a further feature of the present invention, the substantially peripheral flow path defines an axial void, the microwave heater further comprising a plurality of elongated conductors arranged within the axial void, each of the elongated conductors being substantially parallel to the axis.

According to a further feature of the present invention, the substantially peripheral flow path has an inner surface, the microwave heater further comprising a plurality of annular conductors spaced along the inner surface, each of the annular conductors being perpendicular to the axis.

According to a further feature of the present invention, the at least one conduit is formed from glass protected by a fine metallic coating.

According to a further feature of the present invention, the microwave generator is a Cerenkov maser which uses the liquid as a functional dielectric.

According to a further feature of the present invention, the microwave generator is a coaxial-type magnetron having a plurality of circumferentially spaced cavities, and wherein a plurality of the conduits substantially fill the plurality of circumferentially spaced cavities.

There is also provided, according to the teachings of the present invention, a method of heating a liquid comprising the step of passing the liquid through an interaction region of a microwave generator.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
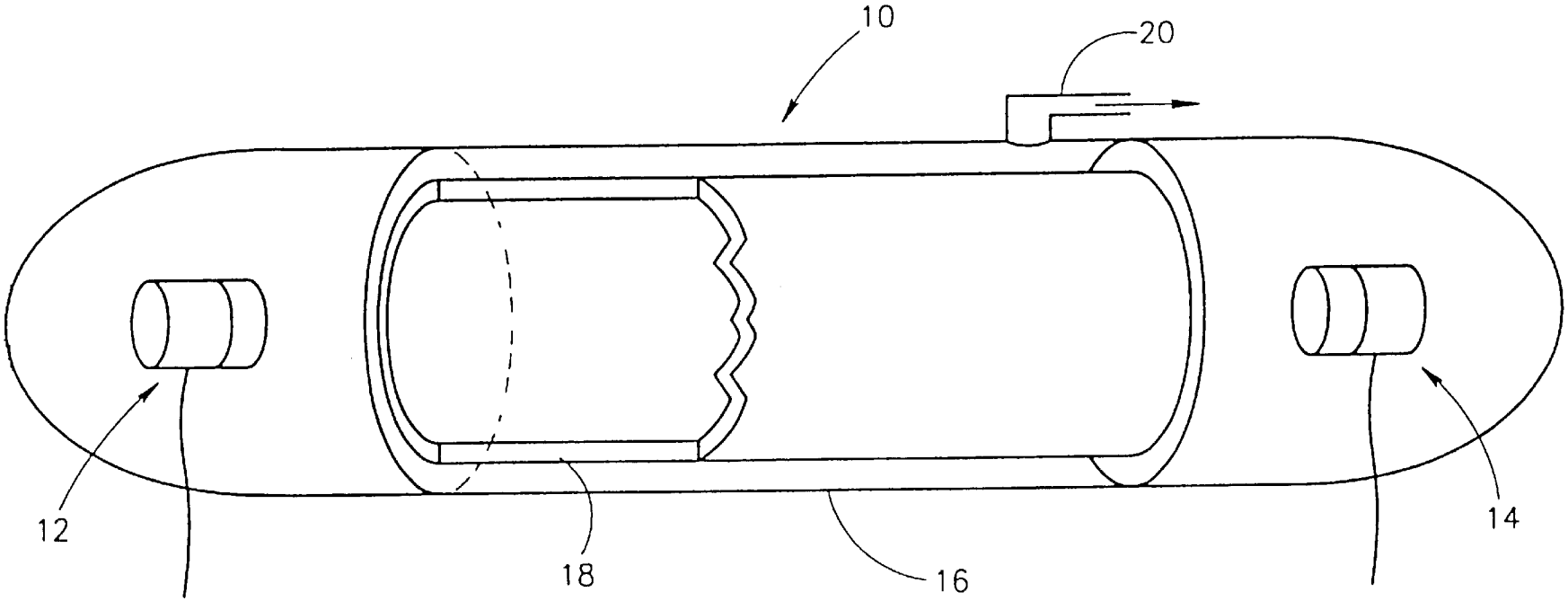
FIG. 1 PRIOR ART
FIG. 1 is a schematic cut-away view of a conventional Cerenkov microwave tube, which is a known version of the conventional travelling-wave tube (TWT)

The present invention is of compact efficient microwave devices for heating liquids.

The principles and operation of microwave devices according to the present invention may be better understood with reference to the drawings and the accompanying description.

Generally speaking, the microwave heaters of the present invention have a microwave generator which includes an interaction region within which microwave radiation is generated and guided. A conduit, with an inlet connected to a liquid source and an outlet connected to a liquid receiver, is deployed within the interaction region so that the liquid can flow through the interaction region. When the microwave generator is activated, the liquid within the conduit acts as a dielectric load of the microwave generator thereby being heated by the microwave radiation.

The term "liquid receiver" is used herein to refer to any destination to which the heated liquid is being supplied. According to the type of application, this may be a tap or another type of point of use, a storage tank, or a next stage of an industrial or chemical process. In some systems, the liquid receiver may be directly or indirectly connected to the liquid source so that the liquid recirculates through the microwave heater, for example to produce and maintain a required temperature in a tank of liquid.

Microwave heaters according to the present invention may be used for heating liquids in a wide range of applications. Domestically, they may replace resistive heating elements in conventional hot water and heating systems, and may provide compact instant-hot-water systems for kitchens, showers and the like. Other possible applications include, but are not limited to, processing of foods such as milk and fruit juices, and processing of fuels. The microwave heaters of the present invention also have many possible applications in industry, wherever a compact, efficient device is required for rapid heating of water or other liquids. In particular, the microwave heaters of the present invention are valuable for chemical processing in which microwaves are used to stimulate specific vibrational modes to activate a chemical reaction. The operating frequency of the microwave heaters may be tuned as appropriate for each application.

Since the microwave heaters of the present invention do not require any waveguide or applicator external to the microwave generator, they are much more compact than conventional microwave heaters. Furthermore, the coupling losses associated with the use of a waveguide are avoided, leading to improved efficiency. Some implementations of the present invention also allow use of much lower voltage electron guns than conventional microwave generators of a similar type, thereby reducing the cost of manufacture and operation of the device.

The principles of the present invention are applicable to any type of microwave generator. However, the details of its implementation vary slightly according to the type of microwave generator to be used. For the purpose of illustration, two embodiments of the present invention will be described: firstly, with reference to FIGS. 1 to 3, a Cerenkov maser device will be described; and secondly, with reference to FIGS. 4 and 5, a coaxial magnetron device will be described. These examples will then enable one ordinarily skilled in the art to apply the principles of the present invention to any of the many different types of microwave generator.

Referring now to the drawings, FIG. 1 shows a conventional Cerenkov maser, generally designated 10. Cerenkov maser 10 is essentially a cylindrical electron tube which has an electron gun 12, a collector 14 and an interaction region 16. Interaction region 16 has a solid dielectric lining 18. A waveguide 20 is coupled to interaction region 16 for carrying microwave radiation to a load (not shown).

As is known, Cerenkov maser 10 produces microwaves as a result of the interaction between a beam of electrons passing through interaction region 16 and electromagnetic waves of similar phase velocity travelling through the dielectric. The dielectric is an essential functional component in the generation of microwave radiation by Cerenkov maser 10.

Figure 2A:
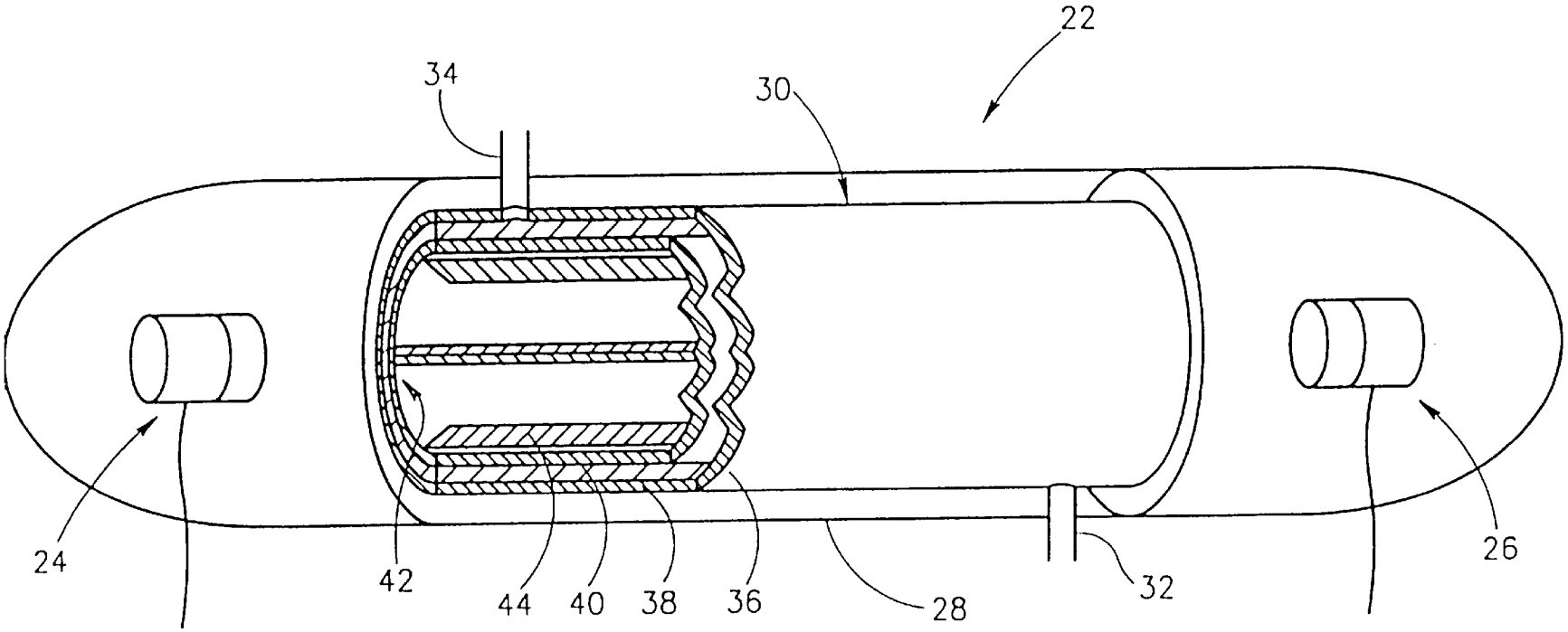
FIG. 2A is a schematic cut-away view of a Cerenkov-type microwave heater, constructed and operative according to the teachings of the present invention.
Figure 2B:
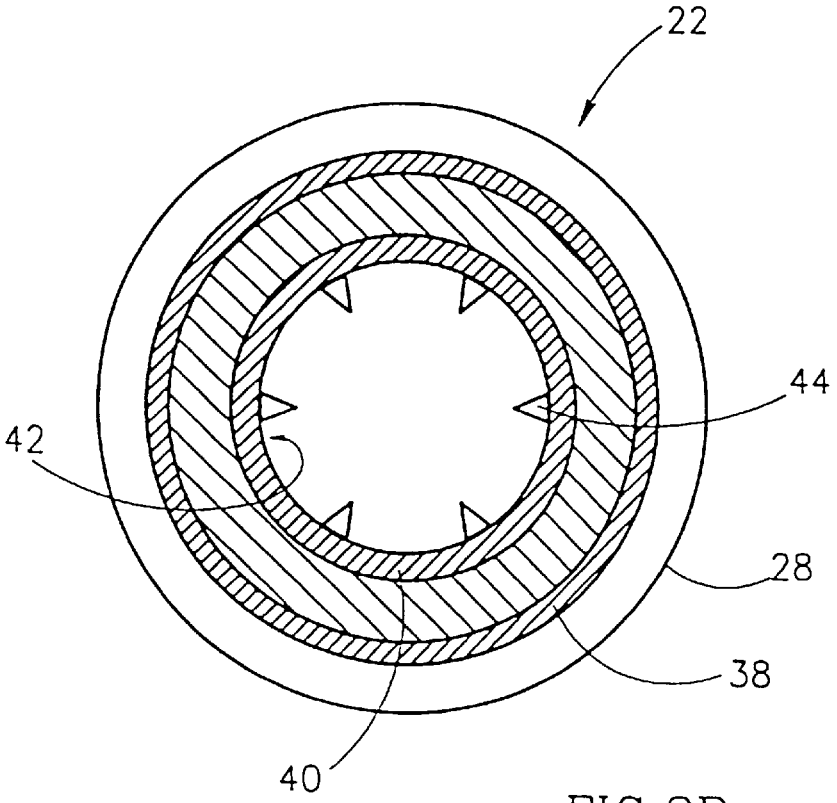
FIG. 2B is a schematic cross-sectional view of the Cerenkov-type microwave heater of FIG. 2A.

Referring now to FIG. 2A and 2B, there is shown a Cerenkov-type microwave heater, generally designated 22, constructed and operative according to the teachings of the present invention. Microwave heater 22 is of generally cylindrical form, similar to Cerenkov maser 10, having an electron gun 24, a collector 26 and an interaction region 28. Instead of a solid dielectric lining, microwave heater 22 has a conduit 30 for carrying a dielectric liquid through interaction region 28. Conduit 30, which is made from material substantially transparent to microwave radiation, such as glass, has an inlet 32 connected to a liquid source (not shown), and an outlet 34 connected to a liquid receiver (not shown). The liquid within conduit 30 and inside interaction region 28 acts simultaneously as the functional dielectric in the production of microwaves and as a load of microwave heater 22, thereby being heated.

Interaction region 28 has a generally cylindrical form. Unless otherwise qualified, the terms "axis" and "axial" are used to refer to the axis of this cylinder.

The features of conduit 30 will now be described in more detail. Conduit 30 is designed to provide a substantially peripheral flow path within interaction region 28. In other words, conduit 30 allows liquid to flow through a large proportion of interaction region 28 while defining an axial void for the path of an axial electron beam.

In a preferred embodiment, conduit 30 has a double-walled tube 36, annular in cross-section, formed between an outer cylinder 38 and an inner cylinder 40. Double-walled tube 36 is coaxially aligned within interaction region 28 so that liquid can flow through interaction region 28 between outer cylinder 38 and inner cylinder 40 while leaving an axial void interior to inner cylinder 40 for the path of the axial electron beam. In order to offset the effects of energy losses from the electron beam along interaction region 28, double-walled tube 36 may be tapered. Tapering of the diameter of double-walled tube 36 along its axis varies the effective dielectric properties of double-walled tube 36. Since the phase velocity of the microwaves depends on the local effective dielectric permittivity, tapering of the double-walled tube 36 may be used to keep the microwave phase velocity synchronized with the decaying speed of the electron beam.

Alternatively, double-walled tube 36 may be replaced by a fine tube wound as a single or multiple helix around the axial electron beam. Similarly, other forms of conduit 30 which provide a substantially peripheral flow path within interaction region 28 may be preferred.

Inlet 32 is preferably connected toward the bottom of double-walled tube 36 and outlet 34 is preferably connected toward its top such that, when microwave heater 22 is in use, convective effects tend to produce a flow of the liquid from the liquid source to the liquid receiver. Alternatively, or additionally, a pump or pressurized supply may be used. Inlet 32 and outlet 34 may be provided with transverse conductive grids to prevent leakage of radiation from interaction region 28, while allowing a flow of liquid.

A particular consideration in the design of the microwave heaters of the present invention is the need to protect conduit 30, and particularly the inner surface 42 of inner cylinder 40 from the electron beam. Since conduit 30 is typically made of glass or other electric insulators, electrons colliding with its surface will tend to generate an accumulation of electric charge and cause damage. The bombardment of the insulator by energetic electrons may release charged particles from its surface. In addition to the damage caused to the insulator itself, this may cause a deflection of the electron beam. These effects can be reduced by one or a combination of a number of methods, as will now be described.

Firstly, as is known in the art, it is generally advantageous to apply an axial magnetic field along interaction region 28, parallel to the electron beam, to restrict the width of the beam. This field also tends to prevent transverse straying of electrons toward conduit 30. The magnetic field may be provided by arrangements of permanent magnets or of one or more electromagnet coils, arranged as is known in the art.

Secondly, at least inner surface 42, and possibly the entire surface of conduit 30, are coated with a fine metallic coating. This prevents localized build-up of charge on the surface of conduit 30. In this context, "fine" is taken to mean any thickness which will not significantly affect microwave transmission, typically in the range from 0.5 to 5 $\mu$m.

Thirdly, a number of elongated conductors 44 are positioned around the periphery of the axial void interior to inner cylinder 40. Each of conductors 44 extends generally parallel to the axis of interaction region 28. Conductors 44 are positioned close to, and may be attached to inner surface 42, and they project slightly inward. Any electron with sufficient velocity transverse to the electron beam to reach conduit 30 will also have a high tangential velocity under the influence of the above-mentioned axial magnetic field. Such an electron will therefore collide with conductors 44 before reaching conduit 30. In addition to protecting conduit 30, elongated conductors 44 provide other advantages. The presence of internal longitudinal conductors within interaction region 28 provides a near-coaxial-type structure able to support TEM modes. Microwave heater 22 can therefore be used at much lower frequencies than an open waveguide-type cavity which is limited by a lower cutoff frequency. For example, frequencies of around 0.9 GHz may be used instead of the conventional 2.45 GHz for heating water. This in turn allows the use of lower voltage electrons.

Finally, conductors 44 may be replaced by various other arrangements of conductors arranged within the axial void interior to inner cylinder 40 so as to enhance, or at least not to significantly impede, propagation of the electromagnetic fields. One example uses a number of annular conductors spaced along the inner surface of inner cylinder 40, each of the annular conductors being perpendicular to the axis. This structure has the advantage of adding longitudinal periodicity to interaction region 28, thereby selecting higher spatial harmonics for a given velocity of electron beam.

Additional features of microwave heater 22 may include a liquid sensor mechanism for deactivating microwave heater 22 when a liquid sensor senses the absence of liquid in conduit 30. Alternatively, microwave heater 22 may be designed such that the generation of microwaves only occurs in the presence of a dielectric liquid, thereby removing the need for a liquid sensor mechanism.

In operation, when microwave heater 22 is activated, microwaves are generated in the same manner as conventional Cerenkov maser 10, with the liquid inside double-walled tube 36 acting as the functional dielectric. The frequency, or range of frequencies of microwaves produced is defined by the geometry of interaction region 28, by the relative permittivity of the liquid and by the energy of the electrons. The extent of interaction between the electron beam and the liquid dielectric, and thus the amount of microwave radiation generated depends on tuning of the energy of the electrons such that the electrons have a velocity just above the speed of microwaves in the dielectric liquid. Since the relative permittivity of materials is often temperature dependent, various possibilities of self-regulating heater designs may be possible. One such possibility, in relation to water heating, will now be described.

Figure 3:
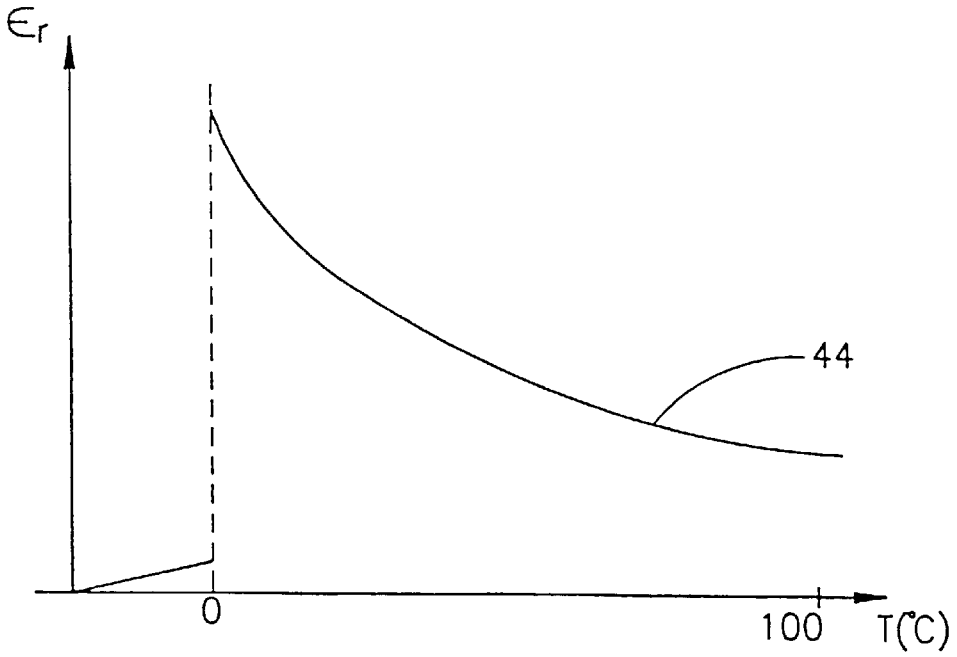
FIG. 3 is a graph showing the variation of the relative permittivity of water with temperature.

FIG. 3 shows the variation, represented by line 44, of the relative permittivity of water with temperature. Over a normal range of operating temperatures (from ambient temperatures to close to boiling) the relative permittivity drops with increasing temperature. By selecting specific geometry of interaction region 28, combined with the use of an electron beam of highly uniform energy, it is possible to produce a self-limiting heating process in which, once the water reaches a pre-determined temperature, negligible interaction occurs between the electron beam and the dielectric (water). In this case, a depressed collector is used to recover the unused energy of the electrons.

Alternatively, a beam of electrons with a wider range of energies may be used so as to continue heating the water to a higher temperature. In this case, other mechanisms are provided to regulate heating, such as a thermostatic cut-out.

Turning now to other embodiments of the present invention, these will be discussed with reference to FIGS. 4 and 5. Whereas, in the first embodiment of the microwave heater, the liquid was replacing the solid dielectric of a Cerenkov maser, in other embodiments the liquid acts as an dielectric load of a microwave generator which would not conventionally contain a dielectric material.

As mentioned above, the invention may be applied to any type of microwave generator, including slow-wave devices such as the travelling-wave-tube (TWT), fast-wave devices such as the gyrotron and cyclotron resonance maser (CRM), the ubitron and free-electron maser (FEM), and linear and coaxial magnetrons.

For all microwave generators based on a linear electron tube, structural considerations are generally similar to those described above with reference to FIGS. 2A and 2B. In a TWT, an axially periodic metallic structure, such as a helix, is arranged coaxially within the axial void so that the electron beam passes along the axis of the periodic structure. In this case, the periodic metallic structure helps protect double-walled tube 36 from damage due to stray electrons. In a CRM, an axial magnetic field is applied. The use of conductors 44 is additionally advantageous, providing rotational periodicity. This selects higher frequency harmonics, thereby enabling use of lower energy electrons.

Of the other embodiments, the coaxial magnetron-type microwave heater is particularly distinct structurally from the first embodiment. This device will therefore be described in some detail with reference to FIGS. 4 and 5.

Figure 4:
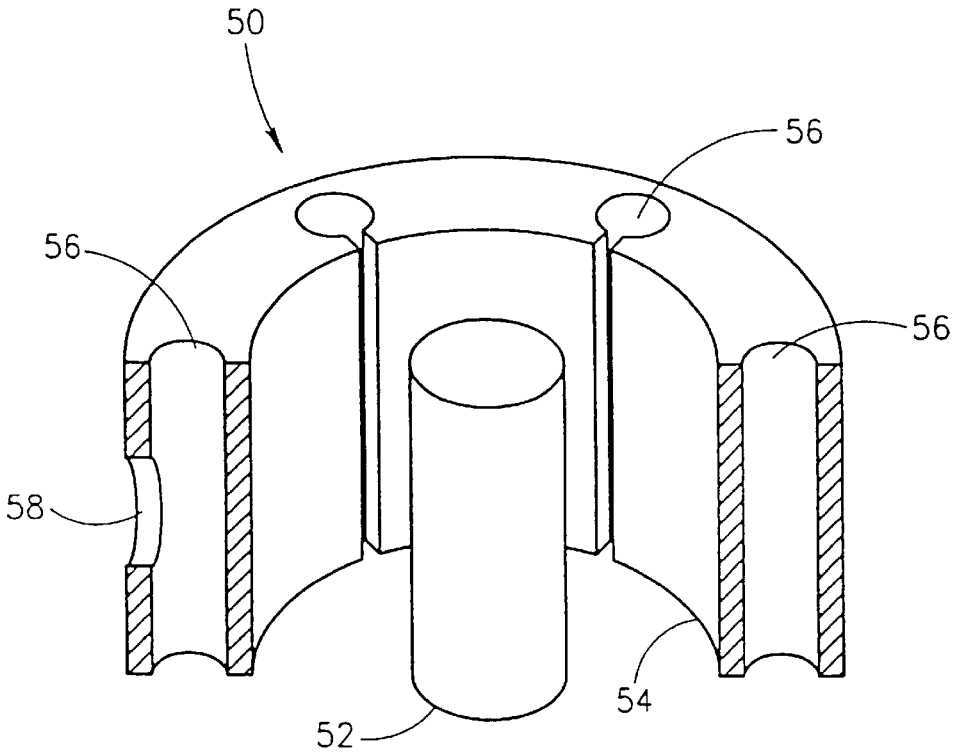
FIG.4 PRIOR ART
FIG. 4 is a schematic cut-away view of a conventional coaxial magnetron.

FIG. 4 shows a conventional coaxial magnetron, generally designated 50. Magnetron 50 has a central cylindrical cathode 52 encircled by a coaxial anode 54. Anode 54 has a number of circumferentially spaced resonant cavities 56. One of resonant cavities 56 has an opening 58 for coupling to a waveguide. A strong magnetic field is applied axially along magnetron 50.

Figure 5:
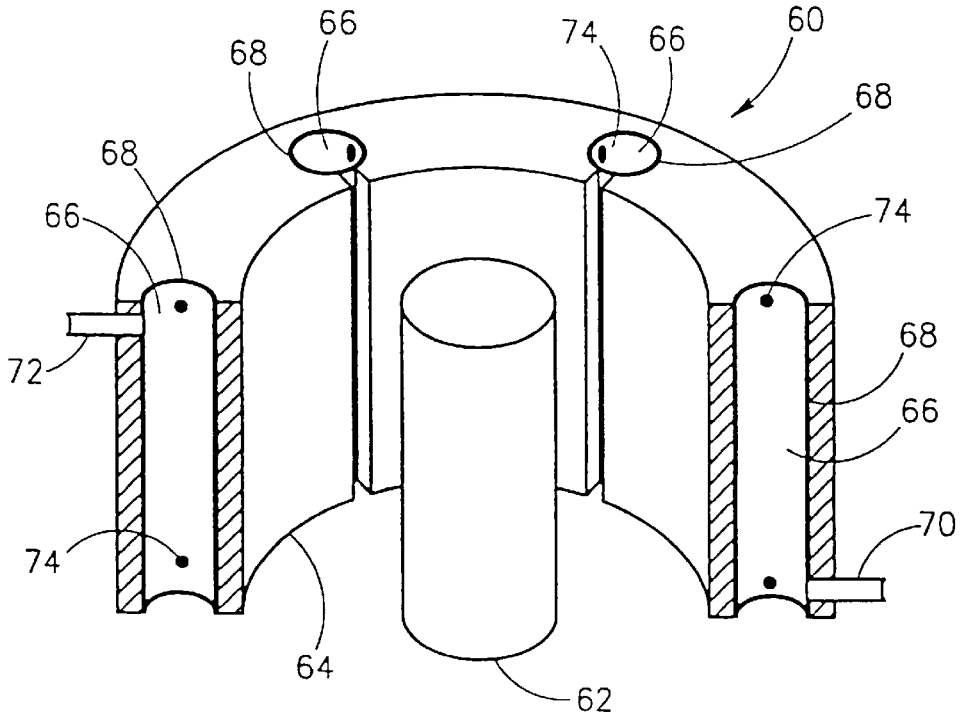
FIG. 5 is a schematic cut-away view of a magnetron-type microwave heater, constructed and operative according to the teachings of the present invention.

FIG. 5 shows a magnetron-type microwave heater, generally designated 60, constructed and operative according to the teachings of the present invention. Microwave heater 60 is generally similar to magnetron 50, having a central cathode 62 encircled by a coaxial anode 64. Anode 64 has a number of circumferentially spaced resonant cavities 66, each closed by a glass seal 68 to form a number of conduits for the liquid to be heated. Resonant cavities 66 have resonant properties equivalent to vacuum cavities of a diameter larger by a factor of the square root of the relative permittivity of the liquid. One interaction region 66 is connected to a liquid inlet 70, and another to an outlet 72. A number of tubes 74 connect between resonant cavities 66, so that liquid can flow from inlet 70 through resonant cavities 66 to outlet 72.

The operation of microwave heater 60 may be understood by analogy to the first embodiment of the invention described above.

It will be appreciated that the principles of the present invention may easily be adapted to any of the many variant structures of magnetron cavity, including open cavities with vanes. In such a case, self-supporting conduits similar to those used in the first embodiment may be used. The flow may be primarily circumferential, or parallel to the axis of the magnetron.

It will be appreciated that the above descriptions are intended only to serve as examples, and that many other embodiments are possible within the spirit and the scope of the present invention.

What is claimed is:

1. A microwave heater which uses electromagnetic radiation for heating liquid flowing from a liquid source to a liquid receiver, the microwave heater comprising a microwave generator having:

(a) a microwave generating tube containing at least one interaction region within which the electromagnetic radiation is generated; and (b) at least one conduit having an inlet connected to the liquid source and an outlet connected to the liquid receiver, a portion of said at least one conduit being deployed within at least one of said at least one interaction region, the liquid flowing through said portion acting as a dielectric load of said microwave generator so as to be heated by the electromagnetic radiation.

2. A microwave heater as in claim 1, wherein said inlet is positioned lower than said outlet such that, when the microwave heater is in use, convective effects tend to generate a flow of the liquid from the liquid source to the liquid receiver.

3. A microwave heater as in claim 1, wherein said at least one interaction region is substantially cylindrical and has an axis, and wherein a beam of electrons passes through said interaction region substantially parallel to said axis, said at least one conduit forming a substantially peripheral flow path within said interaction region.

4. A microwave heater as in claim 3, wherein said substantially peripheral flow path is tapered along said axis so as to synchronize the phase velocity of the electromagnetic radiation with the velocity of said beam of electrons along said interaction region.

5. A microwave heater as in claim 3, wherein said interaction region includes an axially periodic structure.

6. A microwave heater as in claim 5, wherein said axially periodic structure is metallic.

7. A microwave heater as in claim 6, wherein said axially periodic structure is helical.

8. A microwave heater as in claim 3, further comprising means for applying an axial magnetic field through at least part of said interaction region parallel to said axis.

9. A microwave heater as in claim 8, wherein said axial magnetic field is fixed so as to define the frequency of the electromagnetic radiation generated.

10. A microwave heater as in claim 3, further comprising means for applying a magnetic field through at least part of said interaction region substantially perpendicular to said axis.

11. A microwave heater as in claim 3, wherein said substantially peripheral flow path defines an axial void, the microwave heater further comprising a plurality of elongated conductors arranged within said axial void, each of said elongated conductors being substantially parallel to said axis.

12. A microwave heater as in claim 3, wherein said substantially peripheral flow path has an inner surface, the microwave heater further comprising a plurality of annular conductors spaced along said inner surface, each of said annular conductors being perpendicular to said axis.

13. A microwave heater as in claim 1, wherein said at least one conduit is formed from glass protected by a fine metallic coating.

14. A microwave heater as in claim 1, wherein said microwave generator is a Cerenkov maser which uses the liquid as a functional dielectric.

15. A microwave heater as in claim 1, wherein said microwave generator is a cyclotron resonance maser.

16. A microwave heater as in claim 1, wherein said microwave generator is a free electron maser.

17. A microwave heater as in claim 1, wherein said microwave generator is a coaxial-type magnetron having a plurality of circumferentially spaced cavities, and wherein a plurality of said conduits substantially fill said plurality of circumferentially spaced cavities.

18. A method of heating a liquid comprising the step of passing the liquid through a conduit, at least part of the conduit being deployed within an interaction region of a microwave generating tube within which microwave radiation is being generated.

19. The method of claim 18, wherein the microwave generating tube is a magnetron tube.

* * * * *